US005490737A

United States Patent [19]

Gueret

[11] Patent Number: 5,490,737

[45] Date of Patent: Feb. 13, 1996

[54] WIPING DEVICE FOR A FLUID PRODUCT APPLICATOR ASSEMBLY

[75] Inventor: Jean-Louis H. Gueret, Paris, France

[73] Assignee: L'Oreal, Paris, France

[21] Appl. No.: 249,616

[22] Filed: May 26, 1994

[30] Foreign Application Priority Data

Jun. 3, 1993 [FR] France ..... 93 06640

[51] Int. Cl.[6] ..... A46B 11/00; A45D 40/00

[52] U.S. Cl. ..... 401/122; 401/129

[58] Field of Search ..... 401/122, 129; 132/218

[56] References Cited

U.S. PATENT DOCUMENTS

| | | | |
|---|---|---|---|
| 3,316,922 | 5/1967 | Seidler | 401/122 X |
| 3,684,387 | 8/1972 | Glenn | 401/122 |
| 3,861,810 | 1/1975 | Vasas | 401/122 |
| 4,403,624 | 9/1983 | Montgomery | 401/122 X |
| 4,784,505 | 11/1988 | Dahm | 401/122 |
| 4,796,647 | 1/1989 | Gueret | 401/122 X |

FOREIGN PATENT DOCUMENTS

| | | |
|---|---|---|
| 2512653 | 3/1983 | France . |
| 2603780 | 3/1988 | France . |
| 2082553 | 3/1982 | United Kingdom . |
| 2097662 | 11/1982 | United Kingdom . |

*Primary Examiner*—Steven A. Bratlie
*Attorney, Agent, or Firm*—Staas & Halsey

[57] ABSTRACT

Assembly for applying a fluid product, particularly a cosmetic product, including a bottle, a cap to close the bottle, an applicator arranged at an end of a wand attached to the cap, and a wiping device equipped with a lip and fastened to the bottle. The lip of the wiping device includes flocking fibers. When the cap is fastened on the bottle the wand passes through the lip and the applicator is submerged in the fluid product in the bottle. When the cap is removed from the bottle, the applicator passes entirely through the wiping device. The flocking fibers remove excess fluid product from the applicator.

10 Claims, 2 Drawing Sheets

WIPING DEVICE FOR A FLUID PRODUCT APPLICATOR ASSEMBLY

BACKGROUND OF THE INVENTION

The present invention relates to an applicator assembly for a fluid product, particularly a cosmetic product.

The fluid product may be in liquid form or in the form of a cream or of a paste which is more or less viscous. The fluid product is, for example, a mascara or an eyeliner.

Applicator assemblies of this type include, in a known manner, a bottle equipped with a neck, a cap which is fastened, usually by screwing, on the neck in order to close the bottle and an applicator fastened on a wand which is securely attached to the cap. These assemblies also include, in a known manner, a wiping device which is equipped with a generally flexible scraping lip which is fastened on the neck of the bottle and which is intended to remove excess product from the applicator when product is taken out; the applicator usually has, in cross section, over a part of its length, dimensions greater than those of the wand. In these assemblies, in a storage position, when the cap is fastened on the bottle, the applicator is submerged in the product and the wand carrying the applicator passes through the wiping device. When the cap is removed in order to take out product, the applicator passes through the wiping device and the lip of the wiping device scrapes the applicator, which removes excess product from the applicator.

However, this type of applicator assembly has a drawback. The lip of the wiping device generally provides an opening, the cross section of which is of the order of that of the cross section of the wand carrying the applicator, which is necessary in order to ensure the leaktightness of the assembly. Under these conditions, the wand acts as a piston and a reduced pressure is created in the bottle when the wand is removed. When the applicator passes through the wiping device, the wiped-off product is sucked through the effect of the reduced pressure and is deposited at the end of the applicator. A drop or a globule of product thus forms at the end of the applicator, interfering with the make-up process and tending to clog the applicator.

SUMMARY OF THE INVENTION

The present invention relates to an applicator assembly which remedies this drawback.

The subject of the present invention is an assembly for applying a fluid product, particularly a cosmetic product, including a bottle, a cap for closing the bottle, an applicator arranged at the end of a wand securely attached to the cap and a wiping device equipped with a lip, the applicator being entirely submerged in the bottle and the wand passing through the wiping device when the cap is fastened, and the applicator passing entirely through the wiping device when the cap is separated from the bottle when product is taken out. The lip of the wiping device is at least partially flocked with the aid of flocking fibers.

In fact, it has been found that the presence of flocking fibers on the lip of the wiping device makes it possible to obtain a return of air into the bottle which is sufficient for there no longer to be any formation of a reduced pressure when the wand carrying the applicator is removed, while still preserving sufficient leaktightness with respect to the product contained in the bottle. Virtually no drop or globule of product forms at the end of the applicator and, if one does form, the flocking fibers close up like a diaphragm after passage of the applicator and cut off and/or absorb the excess product at the end of the applicator. Moreover, it has been observed that the wand remains cleaner than when there are no flocking fibers present. In addition, it has been observed that the presence of flocking fibers does not alter the effective quantity of product remaining on the applicator.

Flocking is effected in a known manner by at least partially coating the lip of the wiping device with the aid of a bonding agent or liquid adhesive, by spraying or by dipping, then by passing the wiping device, coated with bonding agent, in a bed of flocking fibers held in suspension. The fibers are deposited on the coated surface by means of electrostatic attraction and, in the majority of cases, the fibers are oriented virtually perpendicularly to the coated surface. The flocking fibers may advantageously be made from nylon, cotton, polyester or rayon. Their length is generally between 0.2 and 2 mm.

In the applicator assembly according to the invention, the wand preferably has, in cross section, dimensions smaller than the dimensions of the opening of the wiping device, that is to say dimensions smaller than those necessary for the wand to have just the clearance necessary for passing through the wiping device. The flocking fibers thus preferably have at least the length necessary to fill in the space between the lip of the wiping device and the wand. For example, when the opening of the lip is circular and the wand is cylindrical, the flocking fibers advantageously have at least a length equal to the difference between the radius of the opening and the radius of the cross section of the wand. However, the flocking fibers may have a greater length, even a much greater length, in particular as a function of the end of the applicator from which the excess product must be removed.

According to a preferred embodiment, the wand carrying the applicator includes a restriction arranged at the level of the lip of the wiping device when the cap is fastened, that is to say in a storage position. This thus prevents the wand, during storage, from crushing the flocking fibers when these have a length much greater than that necessary for filling in the space between the lip of the wiping device and the wand outside the restriction.

It should be noted that one advantage of the present invention is that it permits modification of the length of the flocking fibers in order to adapt a given wiping device to a given applicator, equipped with a given wand. In other words, one and the same wiping device may be adapted to several types of applicator simply by modifying the length of the flocking fibers, which is advantageous from an industrial point of view.

The wiping device used according to the invention may have any form known in this type of applicator assembly, particularly in applicator assemblies for mascara. The opening formed by the lip of the wiping device may, for example, be circular, oval or square; it may also be star-shaped. The wiping device may include a skirt or may not include a skirt. If it includes a skirt, this may be split in order to give greater flexibility. The wiping device may include two stages, the two stages forming part of a single piece or of two different pieces. In two-stage wiping devices, preferably only the first stage, that is to say that which is furthest from the cap, is provided with a flocking according to the invention.

The opening of the lip of the wiping device, in the case of applicators for cosmetic products, generally has a maximum dimension in cross section which can vary between 2 mm and 15 mm.

In a known manner, the wiping device may be molded from hard or semi-flexible thermoplastic material or from elastomer.

The applicator may be any applicator known in this type of applicator assembly. It may, for example, include a brush, of a fine brush, of a tip, particularly a conical tip, made from plastic foam or from capillary felt, or of a tip equipped with flocking.

BRIEF DESCRIPTION OF THE DRAWINGS

The description given below, purely by way of illustration and in a non-limiting manner, with reference to the appended drawing, of several embodiments will enable the invention to be better understood.

In the drawings.

DESCRIPTION OF THE PREFERRED EMBODIMENTS

Figure 1:
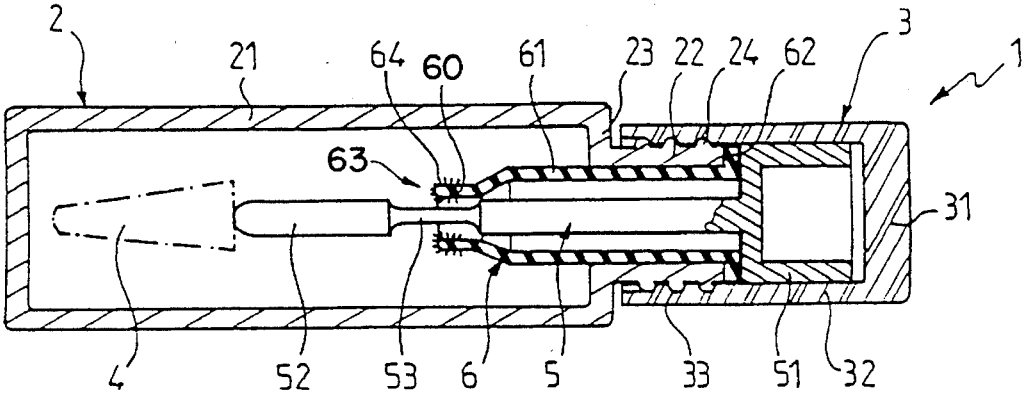
FIG. 1 shows, in longitudinal section, a first embodiment of the applicator assembly according to the invention.

The applicator assembly shown in FIG. 1 is denoted overall by the reference 1. It includes a bottle 2, a cap 3 fastened on the bottle 2, an applicator 4 carried by a wand 5 securely attached to the cap 3, and of a wiping device 6.

The bottle 2 includes a cylindrical body 21 connected to a neck 22 of smaller diameter via a shoulder 23. The neck 22 is equipped on the outside with a screw thread 24.

The cap 3 includes a circular flat base 31 and a cylindrical skirt 32 with a circular cross section, equipped on is its inner face with a screw thread 33 capable of interacting with the screw thread 24 of the neck 22.

The applicator 4, is for example, a spiral brush of general conical shape. The brush is fastened on the wand 5. This wand 5 ends in a cylindrical fastening skirt 51, the outer diameter of which is equal, except for the necessary clearance, to the inner diameter of the skirt 32. The skirt 51 is mounted forcibly in the cap 3. The wand 5 includes a cylindrical element 52 equipped with a restriction 53 of smaller diameter, arranged so that, in a storage position, that is to say when the cover 3 is screwed on the bottle 2, the restriction 53 is located at the level of the lip of the wiping device 6.

The wiping device 6 shown in FIG. 1 is of the type with a skirt. It includes a first cylindrical element 61 with an outer diameter which is equal, except for the clearance necessary for its mounting, to the inner diameter of the neck. The element 61 is equipped at one end with an outer retention flange 62 which rests on the free edge of the neck 22 and, at its other end, with a cylindrical skirt 60 forming a lip 63 of the wiping device 6. This lip 63 is partially covered with flocking fibers 64, these fibers being fastened on the edge and over a certain height of the outer and inner surfaces of the lip 63.

In a storage position (as shown in FIG. 1), the cap 3 is screwed on the neck 22 of the bottle 2. The applicator 4 is contained in the body 21 of the bottle 2 and submerged in the product to be applied; the restriction 53 of the cylindrical element 52 of the wand 5 is arranged at the level of the lip 63 of the wiping device 6.

When the user wishes to take out product, he unscrews the cap 3 and pulls on the wand 5 carrying the applicator 4. The cylindrical element 52 passes into the lip 63 of the wiping device 6, where it is in contact with the flocking fibers 64. The presence of the flocking fibers 64 between the cylindrical element and the lip 63 of the wiping device 6 enables air to penetrate into the bottle 2 and no reduced pressure is formed. The applicator 4 then passes through the lip 63 of the wiping device 6. The lip 63 of the wiping device removes excess product loaded on the applicator 4. The user may then proceed to apply the product. After application, the user returns the applicator into the bottle 2 and screws on the cap 3. The applicator assembly is ready for a subsequent use.

Figure 2:
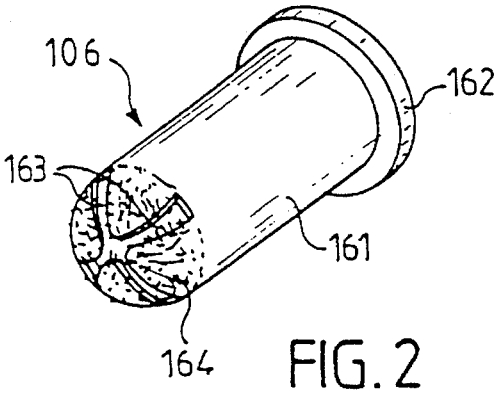
FIGS. 2 and 3 each show, in perspective, a variant of a wiping device according to the invention.

FIG. 2 shows a star-shaped wiping device, denoted overall by 106. The wiping device includes a cylindrical element 161 carrying an outer retention flange 162. A lip 163 of the wiping device 106 includes a domed base closing the element 161 and cut out in the shape of a star so as to form tabs, four tabs in the example shown. Flocking fibers 164 are fastened, in part, on the outer and inner faces of the tabs and on the edges of the latter.

Figure 3:
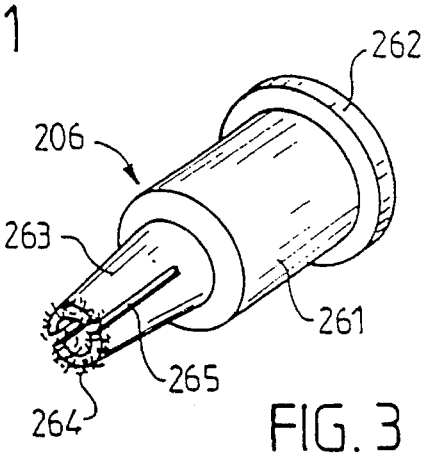

FIG. 3 shows a wiping device with a split skirt which is denoted overall by 206. This wiping device includes a cylindrical element 261 equipped at one end with an outer retention flange 262 and at the other end, with a wiping lip 263. This lip 263 includes a conical skirt equipped with two longitudinal splits 265 which are diametrically opposed and extend over the major part of its height. Flocking fibers 264 are deposited on the edge and over a part of the outer and inner surfaces of the lip 263.

Figure 4A:
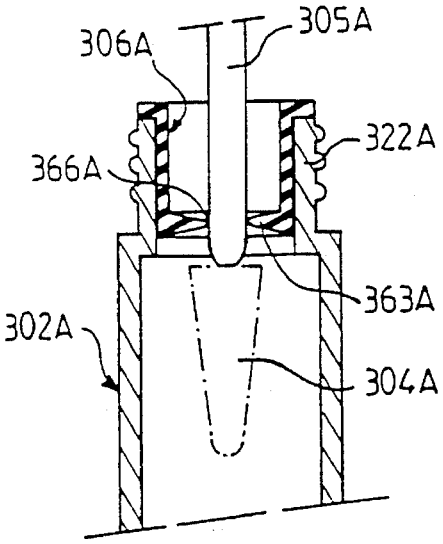
FIG.4A (PRIOR ART)
FIGS. 4A and 4B show, by way of comparison, in partial longitudinal section, an applicator assembly of the prior art (4A) and an applicator assembly according to the invention (4B), and FIGS. 5 and 6 each show, in longitudinal section, a further variant of a wiping device according to the invention.
Figure 4B:
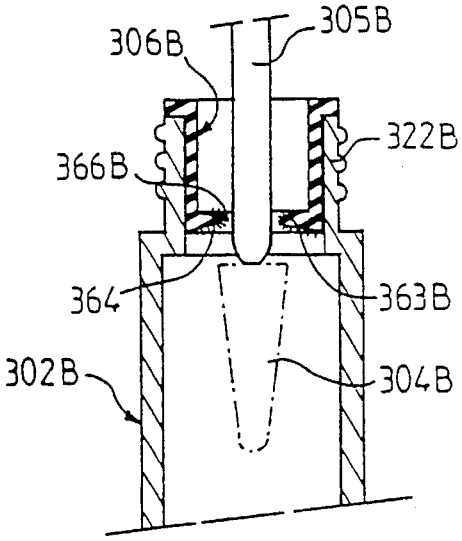

FIGS. 4A and 4B show, respectively, a bottle 302*a*, 302*b*, on the neck 322*a*, 322*b* of which is mounted a wiping device 306*a*, 306*b*, which does not include a skirt. The lips 363*a*, 363*b*, include an annular flange of triangular cross section, providing a circular opening 366*a*, 366*b*. In FIG. 4A, which corresponds to the prior art, it can be seen that the opening 366*a* has a diameter equal, except for the necessary clearance, to the diameter of the wand 305*a* carrying the applicator 304*a*. In this manner, leaks of the product contained in the bottle, during storage, are prevented, however, when the wand 305*a* is removed when product is taken out, a reduced pressure forms in the bottle 302*a*. The product wiped from the applicator does not fall back inside the bottle but is sucked by the reduced pressure and is deposited at the end of the applicator where it forms a drop or a globule which interferes with the make-up process.

The wiping device according to the invention is shown in FIG. 4B. In the wiping device 306*b*, according to the invention, the lip 363*b* is equipped with flocking fibers 364 on its inner and outer faces and on the edge. It can be seen, on this figure, that the diameter of the opening of the lip 366*b* is greater than the diameter of the wand and that the fibers deposited by flocking fill the annular space between the edge of the opening 366*b* and the wand 305*b*. Satisfactory wiping of the applicator is thus obtained, while allowing air to pass. Consequently, a drop or globule of product no longer forms at the tip of the applicator. The annular flange forming the wiping lip 363*b* is also equipped on its face turned towards the bottle with flocking fibers. These fibers have the advantage of braking the return of the wiped product towards the opening of the wiping device 306*b* and consequently prevent the wiped product from returning to the applicator 304*b*.

Figure 5:
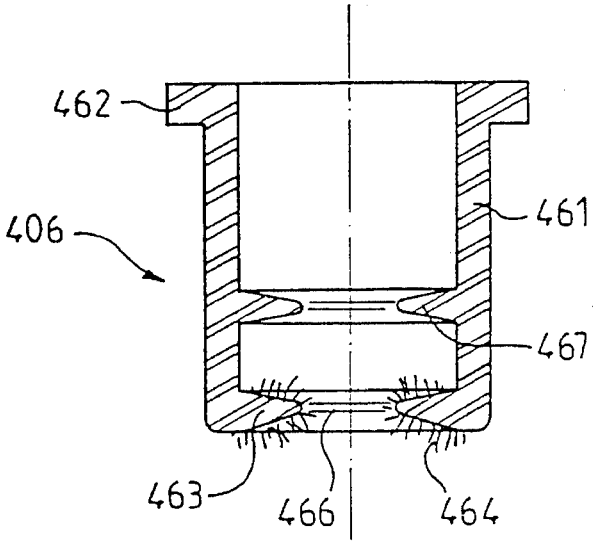

FIG. 5 shows a wiping device 406 according to the invention, including two stages and including a single element or piece 461. It is formed from a cylindrical element equipped at one end with a retention flange 462 turned towards the outside and, at the other end, with a flange forming a wiping lip 463 turned towards the inside, providing an axial circular opening 466. The flocking fibers 464 are deposited on the inner and outer faces and on the edge of the wiping lip 463. Inside the element 461 is arranged a second flange 467 forming a second wiping stage. This second flange 467 has no flocking fibers.

Figure 6:
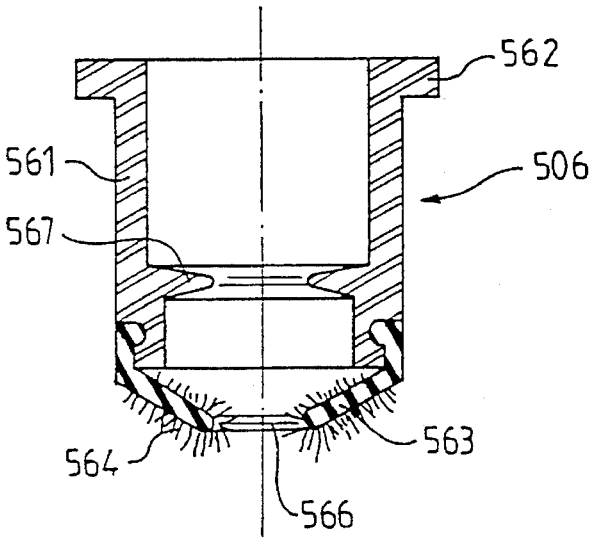

FIG. 6 shows a wiping device 506 with two stages and including two pieces: a first piece has a cylindrical element 561 carrying the retention flange 562 turned towards the outside and the inner flange 567 forming the second wiping stage. The second piece forms the wiping lip 563. It is fastened to the element 561 via a groove/bead system and forms a conical flange providing an axial opening 566. The outer and inner faces and the edge of the flange 563 are covered with fibers 564 by means of flocking.

I claim:

1. Assembly for applying a fluid product, comprising:

a bottle for containing the fluid product;

a cap fastened on the bottle for closing the bottle;

an applicator arranged at an end of a wand attached to the cap; and a wiping device equipped with a lip having an opening about which flocking fibers are attached, said wiping device being fastened to the bottle, wherein, when the cap is fastened on the bottle, the wand passes through the opening in the lip and the applicator is entirely submerged in the fluid product in the bottle and, when the cap is removed from the bottle, the wand passes through the opening and the applicator passes entirely through the wiping device.

2. Assembly according to claim 1, wherein the flocking fibers are made from one of nylon, cotton, polyester and rayon.

3. Assembly according to claim 1, wherein the flocking fibers have a length of between 0.2 and 2 mm.

4. Assembly according to claim 1, wherein a space exists between the wand and the lip, the wand has, in cross section, dimensions smaller than the dimensions of the opening and the flocking fibers fill in the space between the lip and the wand.

5. Assembly according to claim 4, wherein the wand includes a first portion and a second restricted portion corresponding to the position of the lip when the cap is fastened, and the flocking fibers fill in the space between the lip and the restricted portion of the wand.

6. Assembly according to claim 1, wherein the opening is one of circular, oval, square and star-shaped.

7. Assembly according to claim 1, wherein the wiping device includes one of a continuous skirt, a skirt having a split, and two wiping stages.

8. Assembly according to claim 1, wherein the wiping device has two stages, only one of which is flocked.

9. Assembly according to claim 1, wherein the opening has a maximum dimension in cross section, of between 2 mm and 15 mm.

10. Assembly according to claim 1, wherein the applicator is one of a brush, a tip made from plastic, a tip made from capillary foam, a tip equipped with flocking, a fine brush and a felt.

* * * * *